US005551648A

United States Patent [19]

Vodoor et al.

[11] Patent Number: 5,551,648

[45] Date of Patent: Sep. 3, 1996

[54] PRESSURE PLATE POSITIONER FOR A TAPE DISPENSER

[75] Inventors: Sam B. Vodoor, Parlin; Jonathan B. Rivlin, East Brunswick, both of N.J.

[73] Assignee: Central Products Company, Manasha, Wis.

[21] Appl. No.: 316,601

[22] Filed: Sep. 30, 1994

[51] Int. Cl.[6] ..... B65H 23/04; B05C 1/06; B05C 11/00

[52] U.S. Cl. ..... 242/615.3; 242/566; 226/127; 118/264

[58] Field of Search ..... 242/566, 564.1, 242/564.2, 564.4, 615.3, 419.4; 226/127, 128, 129, 130, 131, 132, 133, 135, 137, 195; 83/223, 224, 232, 233, 649, 650; 118/264, 267, 268

[56] References Cited

U.S. PATENT DOCUMENTS

| | | | |
|---|---|---|---|
| 1,921,626 | 8/1933 | Link | 118/264 |
| 1,959,293 | 5/1934 | Phillips | 83/649 |
| 2,333,108 | 11/1943 | Krueger et al. | 83/224 |
| 2,333,109 | 11/1943 | Krueger et al. | 83/233 |
| 2,348,067 | 5/1944 | Hoitt | 118/264 |
| 2,362,755 | 11/1944 | Krueger | 118/264 |
| 2,370,671 | 3/1945 | Krueger | 118/267 |
| 2,408,363 | 10/1946 | Beckman et al. | 83/224 |
| 2,409,872 | 10/1946 | Krueger | 118/267 |
| 2,693,168 | 11/1954 | Hummel | 118/264 |
| 2,761,503 | 9/1956 | Krueger | 83/649 |
| 2,774,593 | 12/1956 | Lewis et al. | 242/419.4 |
| 2,990,991 | 7/1961 | Sharpe | 226/137 |
| 2,994,464 | 8/1961 | Krueger | 226/135 |
| 3,037,477 | 6/1962 | Krueger et al. | 118/40 |
| 3,043,148 | 7/1962 | Krueger et al. | 74/17.8 |

*Primary Examiner*—John M. Jillions
*Attorney, Agent, or Firm*—Pennie & Edmonds

[57] ABSTRACT

The present invention relates to the combination of a tape dispensing machine which includes an exit chute and a pressure plate assembly, and a pressure plate positioner which has at least one support member positioned between the chute and the pressure plate assembly for providing an upward force on the pressure plate assembly to reduce the frictional force on any tape which passes therebetween to prevent jamming of the tape during dispensing. In addition, the invention relates to a method for facilitating the dispensing of relatively thin tapes which comprises providing an upward force on the pressure plate assembly to reduce the frictional force on any tape which passes therebetween to prevent jamming of the tape during dispensing. This upward force is preferably provided by installing the pressure plate positioner described above between the chute and pressure plate assembly of the tape dispenser.

16 Claims, 5 Drawing Sheets

PRESSURE PLATE POSITIONER FOR A TAPE DISPENSER

TECHNICAL FIELD

The present invention relates generally to the field of tape dispensers and particularly to an apparatus for supporting and guiding water-activated adhesive tapes. Specifically, a pressure plate positioner is provided for a tape dispenser to control the deflection of an adhesive tape as the tape travels from a feed mechanism to a brush and pressure plate assembly.

BACKGROUND ART

Tape dispensers made to dispense moistened paper tape for strapping cartons, boxes and the like are well known. Examples of these dispensers are disclosed in U.S. Pat. No. 2,333,108 to Krueger et al, U.S. Pat. No. 2,333,109 to Krueger et al., U.S. Pat. No. 2,370,671 to Krueger et al., U.S. Pat. No. 2,409,872 to Krueger, U.S. Pat. No. 2,761,503 to Krueger, U.S. Pat. No. 2,990,991 to Sharpe, U.S. Pat. No. 2,994,464 to Krueger, U.S. Pat. No. 3,037,477 to Krueger et al., and U.S. Pat. No. 3,043,148 to Krueger. All of these patents are expressly incorporated herein by reference for their disclosure of the specific dispenser devices described therein.

The aforementioned prior art dispensers all have a similar structure, a typical example of which is shown in FIG. 3 of U.S. Pat. No. 2,994,464, reproduced herein as FIG. 1. The frame of the tape dispenser supports and optionally encloses a roll of dry paper tape 22. The tape is generally made of kraft paper which is coated with a water-activated adhesive on one side. The free end of the dry paper tape 24 is pulled through a feeding means, commonly constructed as two parallel feed rolls 28,30. The feed rolls 28,30, typically driven by a hand-operated lever or an electric motor 54, then push the tape along a path 26 through the rest of the dispenser, beneath a pressure plate 38 and over a moistened brush 36. After passing along this path the tape is automatically cut so that it can be easily removed by the user.

One limitation of this prior art system is that the tape must be sufficiently stiff to be pushed through the tape dispenser, yet still be sufficiently pliable after being wetted to easily conform and adhere to an often irregularly shaped box or package. Meeting both these requirements has been difficult for paper tape manufacturers. Yet stiff paper tapes and a weighted pressure plate have essentially solved this problem.

Due to the stiffness of traditional paper tape when dry, the pressure plate historically has been weighted to insure that the paper tape lays flat and is completely moistened as it travels between the pressure plate and the moistening brush. The weight is typically heated to help wet out the adhesive prior to its application to the package or carton.

New water-activated adhesive tapes have been developed recently that are quite dissimilar from traditional paper tapes in mechanical characteristics. Where the traditional paper tapes had a thickness of 7–8 mils, the new thin tapes average about 4–5 mils in thickness. Whereas conventional paper tapes required considerable weight and heat to conform to the moistening brush, the new thin tapes need relatively little weight and no heat. TRU-Seal tapes (using the TRU-TECH manufacturing process), made by Central Products Company of Linden, N.J., are one example of these new thin tapes.

These new thin tapes provide greater strength than prior art paper tapes, yet are more limp and supple than paper tape both when wet and dry. This increased suppleness poses a problem for those who would like to apply these tapes utilizing conventional tape dispensers. Due to their suppleness when dry, the new thin tapes lack the longitudinal rigidity necessary to be pushed through and ejected by such prior art tape dispensers. In practice, they buckle and jam in the paper path between the feed rolls and the pressure plate assembly.

Part of this problem is due to the pressure applied to the new tapes by prior art weighted and heated pressure plate assemblies. The new thin tapes are not as stiff as the old paper tapes and so do not need as much pressure or heat to become sufficiently wetted and activated. Because of the tape's lack of rigidity, the pressure between the pressure plate assembly and the moistening brush causes a great deal of frictional drag on the new thin tapes as the tape passes out of the machine from between the pressure plate assembly and the moistening brush.

Others have attempted to remedy the tape buckling and jamming problem by making major changes to the existing prior art tape dispensers. Better Pack, Inc., of Shelton, Conn., cures the problem by installing a complicated chute structure. This necessitates either a visit from a Better Pack technician, or sending the tape dispenser to Better Pack to be retrofitted.

It is also possible to utilize a more modern tape dispensing machine, such as the Marsh Ultra Gummed Tape Dispenser or the Better Pack models 754 or 755. However, many users have useful older machines, such as the Better Pack model 555L, and these would have to be discarded in favor of the new models at considerable cost.

What is needed, therefore, is a method for preventing tape jamming in conventional tape dispensers, such as the Better Pack Model 555L. Preferably, this method should include an apparatus which can be added to such conventional machines. Furthermore, this apparatus should be compatible with both the traditional paper tapes and the new thin tapes. The present invention provides one such solution to this problem.

SUMMARY OF THE INVENTION

It is an object of this invention to reduce the friction between the pressure plate assembly and the brush to allow freer passage of the new thin tapes. Further in this regard, it is an object of this invention to reduce friction by controlling the position of the pressure plate assembly, thereby reducing the pressure between the pressure plate assembly and the brush.

It is a further object of this invention to allow the use of new thin tapes in existing prior art tape dispensers with relatively minor modifications.

It is yet another object of this invention to reduce the necessity of substantially redesigning existing paper tape dispensers.

It is an additional object of this invention to describe a method for attaching a pressure plate positioner to a tape dispenser that reduces or eliminates disassembly of the tape dispenser, and thereby allows an end user to attach a pressure plate positioner with written assistance, rather than requiring a trained technician.

All the above objects are achieved by use of a pressure plate positioner oriented between a pressure plate assembly and the paper path chute, which provides an upward force on the pressure plate assembly thereby reducing the pressure between the pressure plate assembly and the brush, reducing friction on the tape as it passes between the pressure plate assembly and the brush, and prevents the tape from buckling and jamming the tape dispenser.

BRIEF DESCRIPTION OF THE DRAWINGS

Further details of the preferred embodiments will become apparent upon a review of the drawing figures annexed hereto and made a part hereof, and wherein.

DETAILED DESCRIPTION OF THE INVENTION

Figure 1:
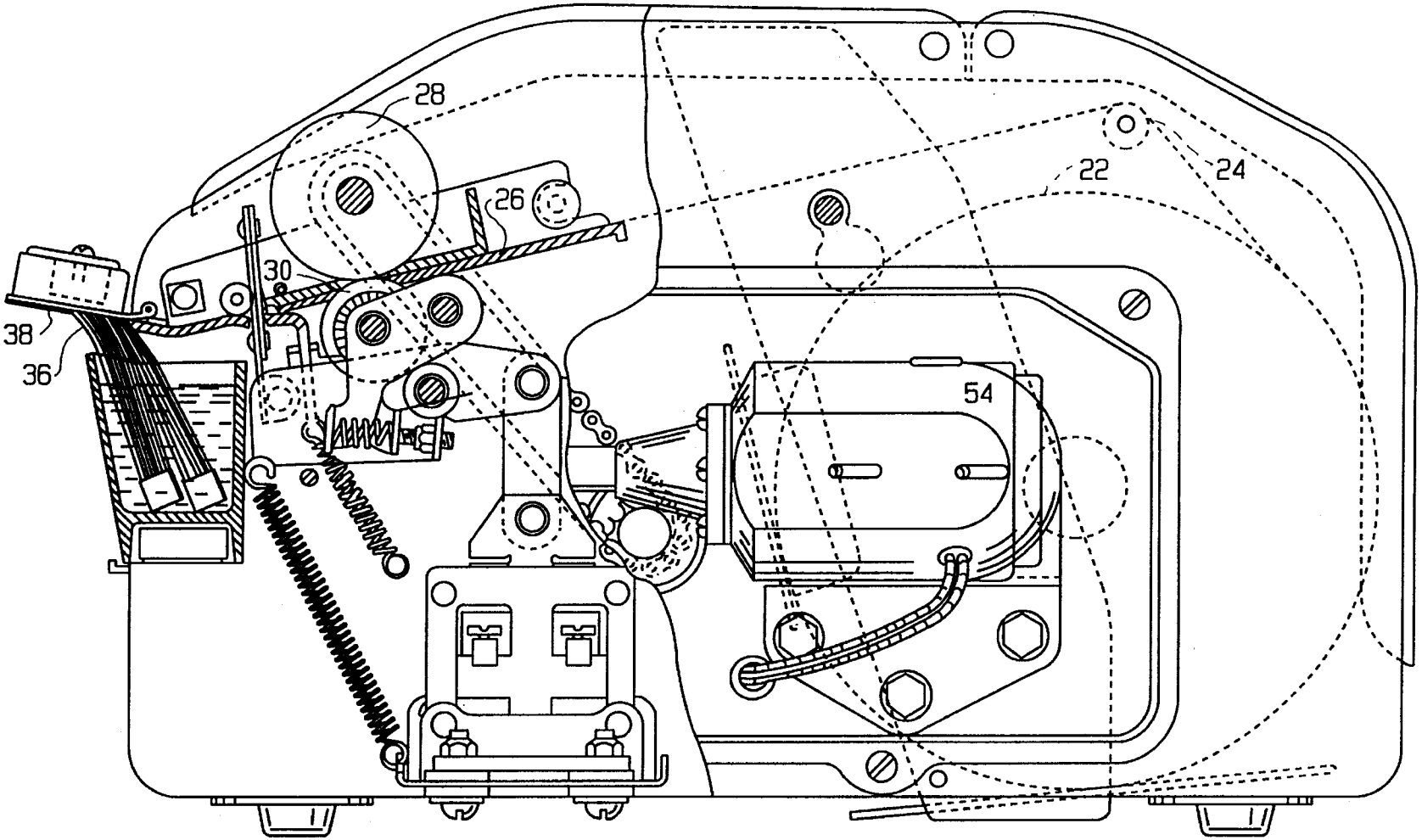
FIG. 1 (Prior Art)
FIG. 1 is a side view, partially in cross section, of a prior art device for dispensing water-activated tapes.
Figure 2:
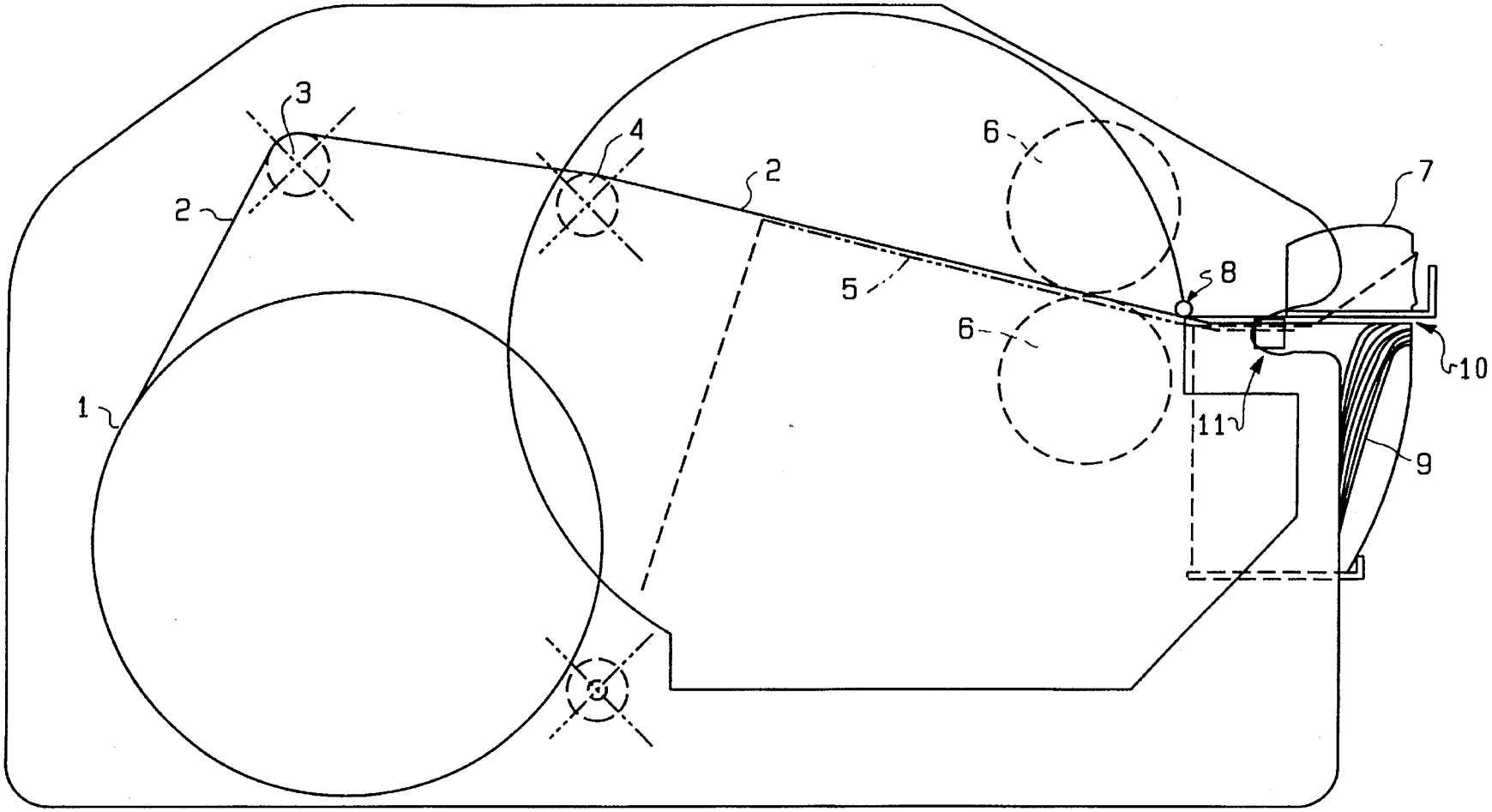
FIG. 2 is a side view, partially in cross section, of the device of the present invention for dispensing water-activated tapes.

FIG. 2 illustrates a tape dispenser with conventional paper tape installed. The dispenser illustrated herein is functionally equivalent to tape dispenser Model 555L, by Better Pack, Inc., as disclosed in U.S. Pat. No. 2,994,464 and above in FIG. 1.

As shown in FIG. 2, tape roll 1 is mounted inside the tape dispenser and feeds dry tape 2 around idler rolls 3 and 4. From idler roll 4, the tape is guided to and is supported by chute 5. At the approximate midpoint of chute 5, two feed rolls 6 contact the dry tape, pull it from the tape roll, and push it along the rest of chute 5 to the exit of the tape dispenser.

A pressure plate assembly 7 is located above the dry tape 2 and chute 5. The pressure plate assembly 7 is supported by and hinges about pivot 8. At its other end, the pressure plate assembly 7 is supported by brush 9. As the dry tape is pushed forward by the feed rolls 6, it passes under pivot 8 and pressure plate assembly 7 until it reaches the contact point between pressure plate assembly 7 and brush 9. It is then forced by the feed rolls 6 between pressure plate assembly 7 and brush 9, is moistened by brush 9, and is ejected to the user at tape exit 10. Pressure plate positioner 11 is shown in its operative position in the pressure plate assembly 7.

As explained above, when the newer relatively thin tapes are used in a dispenser such as that of FIGS. 1 or 2, they cannot be forced between the brush 9 and the pressure plate assembly 7 by the feed rolls 6. Such forcing will cause the new thin tapes to jam inside the tape dispenser.

Figure 3:
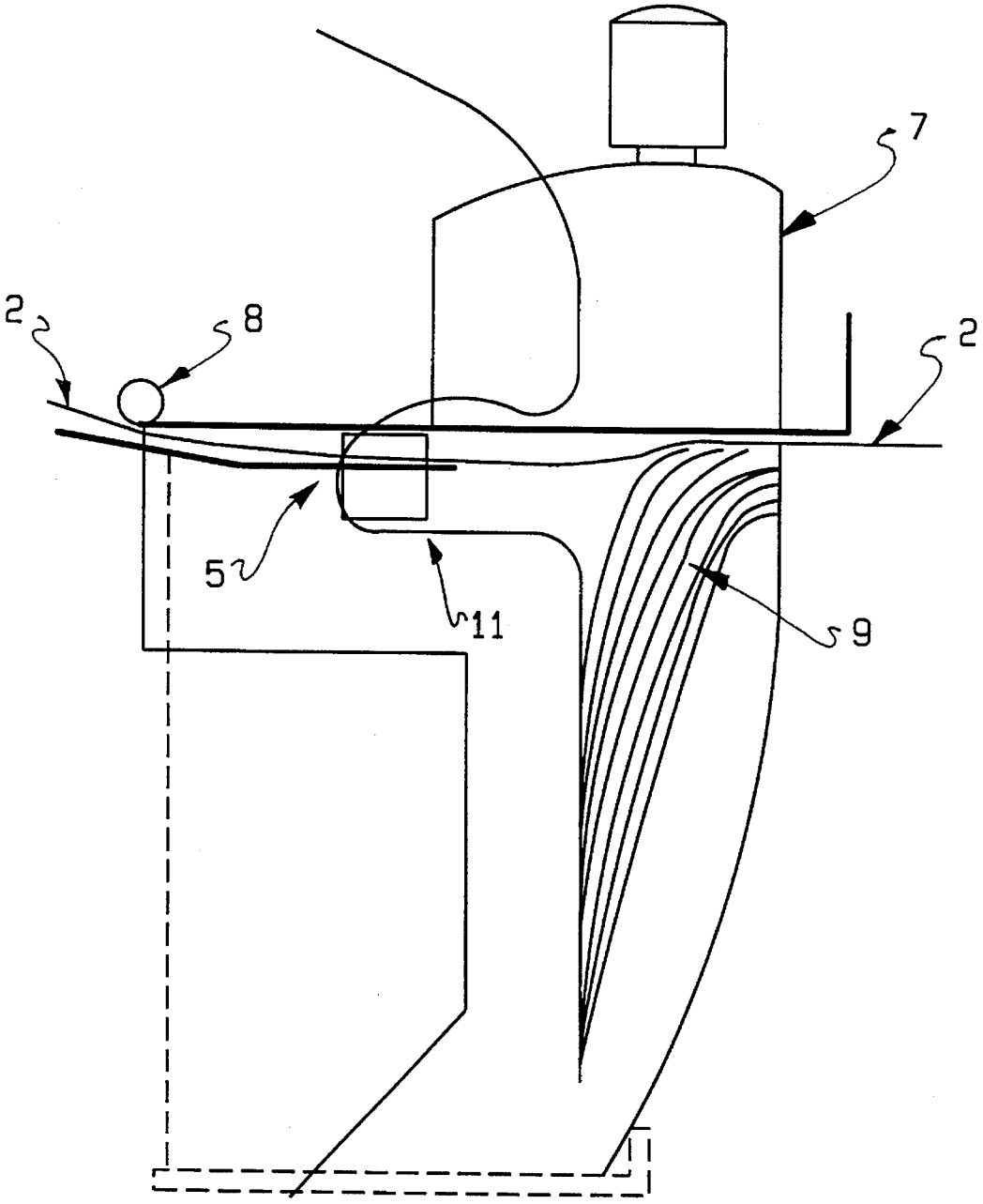
FIG. 3 is an enlarged side view of the device of FIG. 2 to further illustrate the pressure plate positioner of the invention.

FIG. 3 illustrates the tape dispenser of FIG. 2 in an enlarged mode to more clearly identify the features of the pressure plate positioner 11 of the present invention. The operation of the tape dispenser of FIGS. 2 and 3 is essentially same as the operation of the prior art FIG. 1 dispenser, except for the addition of the pressure plate positioner 11. This device 11 is mounted on the chute 5 for partially supporting the pressure plate 7. By partially supporting the pressure plate assembly 7, the upward force provided by the brush 9 against the pressure plate assembly 7 is decreased. This reduction in force between the pressure plate assembly 7 and the brush 9 reduces the frictional force on tape 2 and allows it to pass more easily between pressure plate assembly 7 and brush 9, thus reducing the likelihood of the tape jamming the machine. This is of particular importance when the newer, thinner tapes are utilized.

FIG. 3 is an enlarged side view of a tape dispenser which has the pressure plate positioner attached. In this Figure, the pressure plate positioner 11 is shown mounted on the chute 5 to support the pressure plate assembly 7. When the pressure plate positioner is not attached, no extra upward force is exerted on the pressure plate assembly 7, and the pressure plate assembly 7 would be in a lower equilibrium position. By providing an upward force on the pressure plate assembly 7, it is raised to a predetermined position with respect to the chute 5, and is suspended there. This reduces the frictional force on tape 2 and allows it to pass more easily in the gap between the pressure plate assembly 7 and brush 9.

Figure 4:
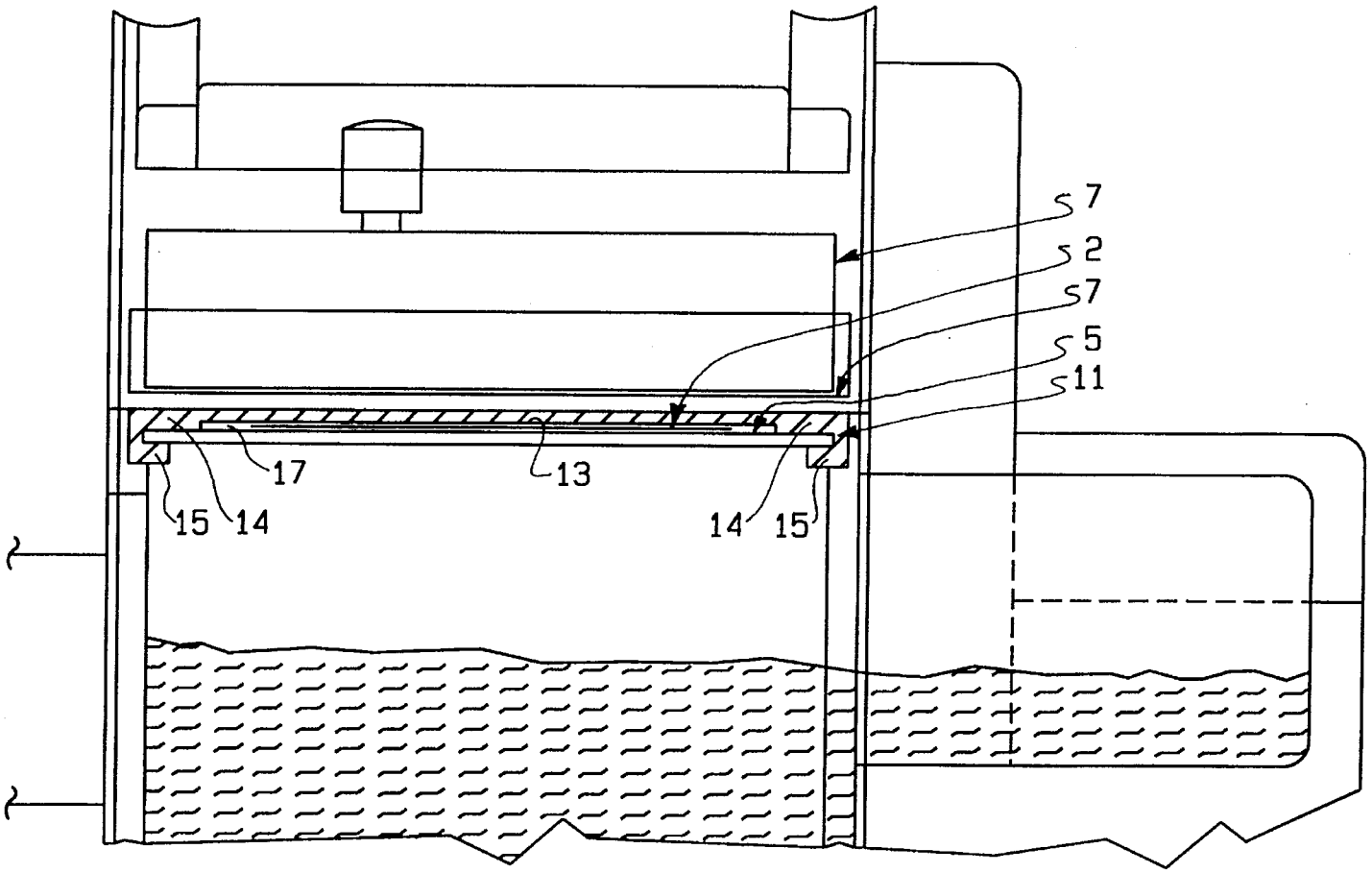
FIG. 4 is an enlarged front view of the pressure plate positioner of FIG. 2.

FIG. 4 is a frontal view of the tape dispenser with the pressure plate positioner 11 attached. The pressure plate positioner 11 includes a longitudinal center section 13 extending from one side of chute 5 to the other. At each end of longitudinal center section 13 are supports 14. These supports extend vertically from the chute 5 to the pressure plate 7 and provide an upward force on pressure plate 7. At the outer edges of pressure plate positioner 11 are clips 15, which extend around the lateral edges of chute 5 and secure the pressure plate positioner 11 to chute 5. In this embodiment, the longitudinal center section 13 is raised above the surface of the chute 5, allowing the tape to pass between the longitudinal center section 13 and the chute 5.

The dimensions of the pressure plate positioner are important to assure proper operation and dispensing of the tape 2. For the positioner 11 of FIG. 4, a typical overall width is 4.5", and the thickness of the center section 13 is 0.075". Preferably, the tape passage 17 beneath the center section 13 is 3.6" wide and 0.055" high. The height is provided by the thickness of supports 14. The dimensions of the tape passage 17 are selected to accommodate different conventional tape widths while still allowing contact between these tapes and the brushes. If the center section 13 is too high, the pressure plate does not sufficiently contact the tape with the brushes, so that the adhesive is not properly wetted and activated. Also, if the thickness of the central section is reduced too much, sagging can occur when it is placed onto the chute and put into operation. Depending upon the selection of the particular material of construction of the pressure plate positioner 11 and the size of the tape 2 which is to be dispensed, the tape passage 17 dimensions can vary from 1" to 4" in width and 0.05" to 0.1" in height.

The dimensions of the clips 15 are not critical provided that they do not interfere with the brush 9. Typically, the size of slot for engaging the chute is designed to match the thickness of the chute 5, and is typically 0.065". The lower part of each clip has a thickness of about 0.05" to 0.125", preferably 0.0625", and a width of about 0.125" to 0.3", preferably 0.25".

Figure 5:
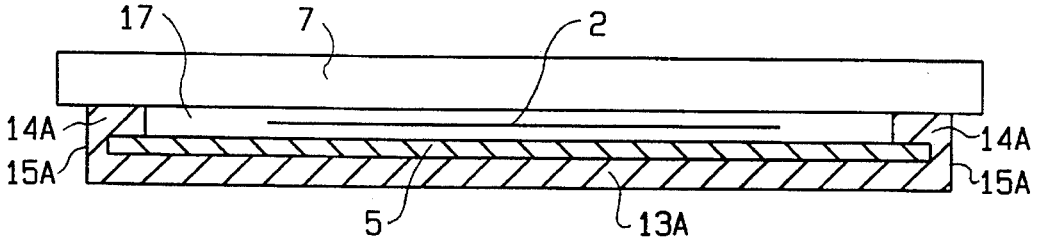
FIG. 5 is an enlarged cross-sectional front view of a second embodiment of the pressure plate positioner of the invention.

FIG. 5 is a cross-sectional view of an alternate embodiment of pressure plate positioner 11 shown in relation to a tape 2 and chute 5. In this embodiment, the longitudinal center section 13A extends from one side of chute 5 to the other, but is located underneath the chute 5. For this embodiment, center section 13A can be thinner than section 13 of FIG. 4, since its sole purpose is to retain supports 14A in spaced relation. If desired, clips 15A can be provided, but such are not necessary due to the provision of center section 13.

Figure 6A:
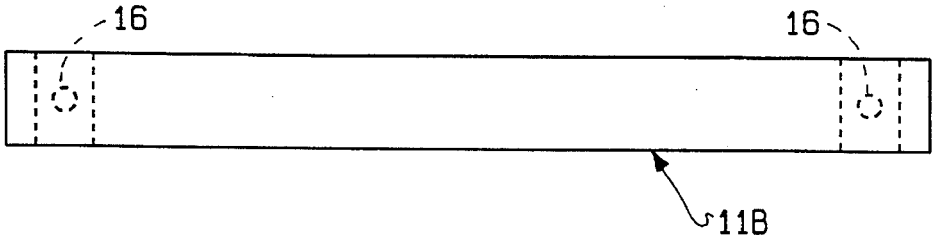
FIGS. 6A and 6B are top and side views, respectively, of a third embodiment of a pressure plate positioner of the invention.
Figure 6B:
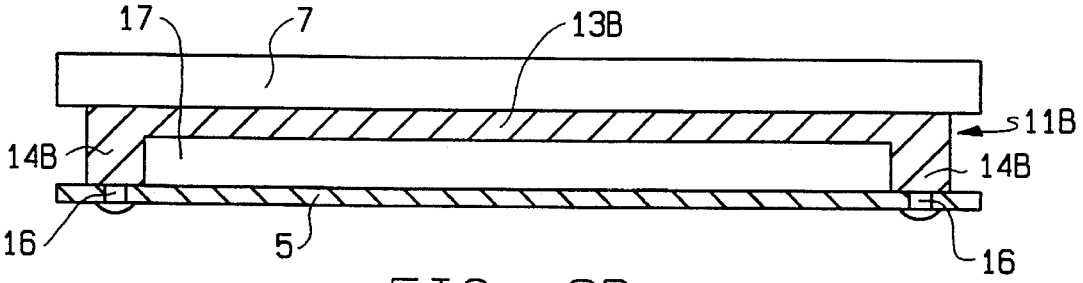

FIGS. 6A and 6B illustrate another embodiment of the invention, wherein a portion 16 of the pressure plate positioner passes through chute 5 and secures the positioner 11 to the chute 5. The positioner 11B includes center section 13B and supports 14B which are similar to those of the preceding embodiments. Two different securing means, in the form of screws 16, are utilized for securing the pressure plate positioner 11B to the chute 5 are illustrated. However, one of ordinary skill in the art would recognize that many other means would suffice, such as, for example, POP-RIVETS™, adhesives, bolts or springs.

Figure 7:
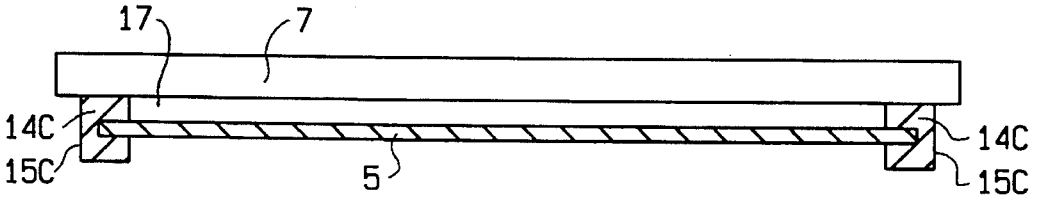
FIG. 7 is a front view of a fourth embodiment of the pressure plate positioner of the invention.

FIG. 7 is a cross-section of another embodiment of the pressure plate positioner in which the positioner supports 14C and clips 15C are similar to those of FIG. 4 but are not connected by a common longitudinal section. The clips 15 secure the positioner to the end of the chute 5 beneath the pressure plate assembly 7. While FIG. 7 shows two pressure plate positioners, one on either side of the chute 5, it is anticipated that a single pressure plate positioner will suffice for most applications.

The positioner of FIG. 7 is not preferred from the standpoint that it is possible, although unlikely, that the clips can be dislodged from the ends of the chute. This is a greater problem where only one positioner is used. Thus, the embodiments of FIGS. 2–6 are preferred, since the positioners are retained more securely in position for proper operation of the tape dispenser when relatively thin tapes are to be used.

The embodiments described thus far indicate a pressure plate positioner secured to chute 5. While this is the more preferred embodiment, a person skilled in the art would recognize that the pressure plate positioner illustrated in each of the figures can be reversed such that the pressure plate positioner 11 is secured to the pressure plate assembly 7 rather than the chute 5.

A significant advantage to the design of the present pressure plate positioner is the ease with which it can be attached to a tape dispenser. Unlike an apparatus similar to that produced by Better Pack referred to above, wherein the tape dispenser must be substantially disassembled and internal parts adjusted or replaced, any of the pressure plate positioners of the present invention can be quickly and easily attached to an existing tape dispenser without difficulty.

To attach the pressure plate positioner, the pressure plate assembly is raised, separating the pressure plate assembly from the chute, and the pressure plate positioner is attached to the tape dispenser. If the pressure plate positioner uses clips to secure it to the tape dispenser, attaching the positioner to the tape dispenser is simply a matter of clipping the pressure plate positioner to the chute or in the pressure plate assembly, as the case may be. If, on the other hand, the pressure plate positioner is secured to the tape dispenser differently, such as by a securing means passing through holes in the chute or pressure plate assembly, the pressure plate positioner can simply be positioned near a securing hole or holes in the chute or in the pressure plate assembly, and then passing the securing means through the securing hole or holes.

What is claimed is:

1. The combination of a tape dispensing machine which includes an exit chute and a pressure plate assembly, and a pressure plate positioner comprising at least one support member positioned upon the chute and having a center section which spans the width of the pressure plate assembly for providing an upward force on the pressure plate assembly and a gap between the pressure plate and the chute to reduce the frictional force on any tape which passes therebetween to prevent jamming of the tape during dispensing.

2. The combination of claim 1 further comprising means for securing the positioner to the machine.

3. The combination of claim 2 wherein the securing means secures the positioner to the chute.

4. The combination of claim 2 wherein the securing means is a clip member which engages an edge of the chute.

5. The combination of claim 4 wherein two support and clip members are included, one on each opposite edge of the chute.

6. The combination of claim 2 wherein the chute includes a hole for receiving a portion of the securing means.

7. The combination of claim 6 wherein the securing means extends through the hole in the chute to attach the support member thereto.

8. The combination of claim 7 wherein said securing means secures the positioner to the pressure plate assembly.

9. The combination of claim 2 wherein the securing means comprises an adhesive.

10. The combination of a tape dispensing machine which includes an exit chute and a pressure plate assembly, and a pressure plate positioner comprising at least one support member positioned upon the chute and having a center section which spans the width of the pressure plate assembly, a support member on each end of the center section, a clip member associated with each support member engaging opposite edges of the chute for securing the positioner thereto, wherein the support members, clip members and central section form an integral component which provides an upward force on the pressure plate assembly and a gap between the pressure plate and the chute to reduce the frictional force on any tape which passes therebetween to prevent jamming of the tape during dispensing.

11. The combination of claim 10 wherein the center section contacts the pressure plate assembly and assists in providing the upward force thereon.

12. The combination of a tape dispensing machine which includes an exit chute and a pressure plate assembly, and a pressure plate positioner comprising first and second support members, first and second means for securing the first and second support members, respectively, to the chute, and a center section extending laterally across the chute.

13. The combination of claim 12 wherein the first support member and the first securing means form an integral component.

14. The combination of claim 13 wherein the second support member and the second securing means form an integral component.

15. The combination of claim 14 wherein the center section forms an integral component with the first and second support members and securing means.

16. The combination of claim 15 wherein the center section contacts the pressure plate assembly and assists in providing the upward force thereon.

* * * * *